US005893951A

United States Patent [19]

Madrzak et al.

[11] Patent Number: 5,893,951

[45] Date of Patent: Apr. 13, 1999

[54] APPLICATOR AND METHOD FOR DIRECT OR INDIRECT APPLICATION OF A LIQUID OR PASTY COATING MEDIUM ONTO A TRAVELING MATERIAL WEB

[75] Inventors: Zygmunt Madrzak; Anton Plomer, both of Heidenheim, Germany

[73] Assignee: Voith Sulzer Papiermaschinen GmbH, Heidenheim, Germany

[21] Appl. No.: 08/905,275

[22] Filed: Aug. 6, 1997

[30] Foreign Application Priority Data

Aug. 7, 1996 [DE] Germany ..... 196 31 888

[51] Int. Cl.[6] ..... B05C 3/02

[52] U.S. Cl. ..... 118/413; 118/123; 118/126; 118/122; 118/118

[58] Field of Search ..... 425/466, 381, 425/382.4, 461, 467; 118/410, 669, 123, 126, 122, 117, 261, 118, 262, 119, 304, 413, 414

[56] References Cited

U.S. PATENT DOCUMENTS 5,575,851 11/1996 Abe et al. ..... 118/410

*Primary Examiner*—Brenda A. Lamb

*Attorney, Agent, or Firm*—Taylor & Associates, P.C.

[57] ABSTRACT

The invention relates to an applicator for direct or indirect application of a liquid or pasty coating medium onto a traveling material web, notably of paper or cardboard, including at least one adjustable coating edge delimiting apparatus for adjustment of a coating width on an applicator roll, backing roll and/or a traveling material web. The coating edge delimiting apparatus is arranged so as to be movable stepwise or continuously in a direction substantially transverse to the direction of travel of the material web.

5 Claims, 3 Drawing Sheets

APPLICATOR AND METHOD FOR DIRECT OR INDIRECT APPLICATION OF A LIQUID OR PASTY COATING MEDIUM ONTO A TRAVELING MATERIAL WEB

BACKGROUND OF THE INVENTION

1. Field of the Invention

The present invention relates to an applicator and method for direct or indirect application of a liquid or pasty coating medium onto a traveling material web, notably of paper or cardboard.

2. Description of the Related Art

Applicators of the type described above are used in conjunction with so-called coaters to provide one or both sides of a traveling material web consisting, e.g., of paper, cardboard or textile material, with one or several layers of a coating medium, for example, dye, starch, impregnating fluid or the like.

In the so-called direct application, the liquid or pasty coating medium is applied by an applicating apparatus directly onto the surface of the traveling material web, which during application is carried on a revolving backing surface, for example, an endless belt or a backing roll. In the indirect application of the medium, in contrast, the liquid or pasty applicating medium is first applied onto a substrate surface, e.g., the surface of a backing roll fashioned as an applicator roll, and is transferred there, in a nip through which the material is passed, from the applicator roll to the material web.

Categorical applicators are known from DE-PS-4425137, DE-OS-3438181 and U.S. Pat. No. 5,435,847 and include a backing roll, on which travels a material web to be provided with a liquid or pasty coating medium. Also included are an applicating apparatus opposing the backing roll and serving to apply the coating medium, and a doctor element following the applicating apparatus and extending across the entire machine width, for example, a doctor blade, which removes surplus applied coating medium. Furthermore, such applicators include at least one adjustable coating edge delimiting apparatus for setting the coating width on an applicator roll, backing roll or the traveling material web.

The applicator according DE-PS 4425137 possesses as applicating apparatus a coating chamber formed between a slice and the doctor element, which chamber is sideways sealed by sealing blocks. Employed as coating edge delimiting apparatus are two deckle plates which are coordinated with the side edges of the traveling material web and each retained by a deckle plate holder joined to the respective sealing block. A coating edge delimiting element formed thereby, for adjustment of the coating format, is movable by means of a sliding element in a direction transverse to the traveling direction of the material web, and remains during the operation of the applicator in the position once set.

The applicator according to DE-OS 3438181 resembles substantially that of DE-PS-4425137, but possesses coating edge delimiting apparatus elements that are provided separately from the lateral deckle blocks or deckle plates of the coating chamber and allow setting and locking relative to the backing roll. More exactly, these coating edge delimiting elements are so-called edge scrapers, which, analogously to the deckle plate according to DE-PS 4425137, remain during the operation of the applicator in the position once set.

The applicator according to U.S. Pat. No. 5,435,847 also corresponds substantially to those pursuant to DE-OS-3438181 and DE-PS-4425137. But it possesses as coating edge delimiting apparatus two deckle slides that are each associated with a side edge of the traveling material web. The deckle slides seal, sideways, a gap formed between two opposing walls. Each deckle slide is for adjustment within the gap of the coating width on the traveling material web in a direction transverse to the traveling direction of the material web. Each deckle slide can be fixed and remains during the operation of the applicator in the position once set.

These prior applicators have various disadvantages, which will be more fully explained now with reference to the attached FIG. 3. Shown in FIG. 3 is a schematic plan view of a prior-art applicator in the area of the doctor element and of the material web edge, with the doctor element, here, a doctor blade 14, folded over in the plane of the material web, for better illustration. Already coated with a liquid or pasty coating medium 4 by means of a not illustrated applicating apparatus, the material web 6 with a width $B_M$ is carried on a backing roll 2 having a width $B_W$. The areas of the material web 6 coated with the pasty coating medium 4 are illustrated stippled in FIG. 3. As shown in FIG. 3, a faster and greater local wear 24 of doctor element 14 and sort of a scoring effect occurs at the transition between the coated $B_G$ and uncoated (edge) area $B_R$. The service life of doctor element 14 is considerably reduced thereby, requiring more frequent replacement of this component, greater cumulative downtime of the applicator, and, consequently, higher operating costs. Due to the aforementioned point of wear 24, doctor element 14 is normally no longer usable even with a format adjustment modified relative to the original setting, that is, with a modified coating width $B_G$, since wear point 24 may lead to an undesirable coating irregularity and quality impairment of the finished product. Hence, doctor element 14 normally must be replaced by another. When the transition between coated $B_G$, and uncoated edge area $B_R$ is located not on the applicator roll or backing roll 2, but on material web 4 itself, considerable problems in winding, unwinding or rewinding of material web 4 may additionally occur, due to the abrupt thickness difference of material web 4 resulting therefrom, i.e., the thickness difference between the coated $B_G$, and uncoated $B_R$ material web section.

SUMMARY OF THE INVENTION

The present invention provides a simple and effective applicator as well as a suitable method for direct or indirect application of a liquid or pasty medium onto a traveling material web, notably of paper or cardboard. Such an applicator extensively avoids the technical problems associated with the prior art and enables the production of a high-quality finished product.

Accordingly, the inventional applicator for direct or indirect application of a liquid or pasty coating medium onto a traveling material web, notably of paper or cardboard, comprises at least one adjustable coating edge delimiting apparatus for adjusting the coating width on an applicator, backing roll and/or the traveling material web. The coating edge delimiting apparatus is mounted so as to be movable stepwise or continuously in a direction substantially transverse to the traveling material web, toward the machine center. The coating edge delimiting apparatus comprises normally at least two coating edge delimiting elements, namely one for each edge of the material web, applicator roll and/or backing roll of the applicator. These elements are deckle plates, edge scrapers or deckle slides. Deckle slides may be arranged in the dosing slot of an applicator configured as an open-jet nozzle such that the deckle slides bound the dosing slot on the side edges. A relevant deckle slide is movable stepwise or continuously in the longitudinal direction of the dosing slot. Other designs of the coating edge delimiting apparatus are possible, of course, in the framework of the invention.

The applicator according to the invention allows in an easy and effective manner a considerable reduction and equalization of the local wear, or of the scoring effect on the doctor element at the transitions between the coated and uncoated edge, and thus an extension of the service life of the doctor element. As compared to the prior art, this enables longer service intervals before the required replacement of the doctor element, thereby reducing, in turn, cumulative downtime of the applicator and overall operating costs. With no pronounced local point of wear occurring on the doctor element with the inventional applicator, the doctor element is usable for a format setting modified relative to the original setting, i.e., a new coating width, without requiring a replacement of the doctor element or involving a quality reduction of the finished product. Also, in the case where the transitions between the coated and uncoated edges are not located on the applicator roll or backing roll, but on the material web itself, an abrupt thickness difference can be effectively avoided between a coated and uncoated section of the material web. The applicator according to the invention produces a soft or "blurred" transition between the coated and uncoated section of the material web, largely eliminating the complications in winding, unwinding and rewinding the material web and facilitating the handling of the finished product. The stepwise or continuously movable arrangement of the coating edge delimiting apparatus of the applicator according to the invention allows an easy technical realization. Lastly, existing applicators can be retrofitted easily to an applicator according to the invention and thus improved with little expense.

A design feature of the invention provides for at least one drive system which powers the coating edge delimiting apparatus and/or moves it as needed for adjustment of the coating width. Generally, the drive system is at least one manually or mechanically powered device, for example, at least one electronic, pneumatic, hydraulic, magnetic or electromagnetic actuator or a corresponding motor etc. or mixed forms thereof. The drive system may feature, depending on its configuration, suitable drive means, transmitting elements, connecting elements and the like. The coating edge delimiting apparatus usually includes, as mentioned above, at least two coating edge delimiting elements, namely one on each edge of the material web, the applicator roll or the backing roll. A drive facility of its own is suitably coordinated with each coating edge delimiting element. Similarly, of course, a joint drive system is conceivable.

A further embodiment of the inventional applicator includes at least one control and/or regulating system that communicates with the drive. The control and/or regulating system, when needed, allows not only an easy automatic adjustment of the coating width but also, for example, presetting the exact form of motion of the stepwise, continuous or oscillating movement of the coating edge delimiting apparatus and/or its control and/or adaptation to varying operating conditions.

The inventional process for direct or indirect application of a liquid or pasty coating medium onto a traveling material web, notably of paper or cardboard, by means of an applicator including at least one adjustable coating edge delimiting apparatus for adjustment of the coating width on an applicator roll, backing roll and/or the material web, is characterized by stepwise or continuous and/or oscillating movement of the coating edge delimiting apparatus in a direction extending largely transverse to the direction of travel of the fiber material web. The method according to the invention offers the advantages already illustrated in detail that are associated with the inventional apparatus.

For the oscillating movement of the coating edge delimiting apparatus, on which, of course, a continuous or stepwise movement may be superimposed, a plurality of oscillation forms are available, for example, harmonic, inharmonic, periodic or aperiodic oscillations. Specifically, the amplitude and/or wavelength of the oscillating motion may vary in operation. The motion may also be performed in intervals, i.e., the coating edge delimiting apparatus keeps an initial adjustment substantially constant for a specific period of time (or a longer period of time, if needed) and then slowly or swiftly changes to a second setting which then, in turn, is kept substantially constant for a specific period of time. Similarly, with a stepwise motion, the step width may be constant or may vary.

With the usual applicator dimensions, one process variant in which the oscillating motion has an amplitude of about 10 mm has proved especially advantageous. Naturally, the invention is not limited to this value.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
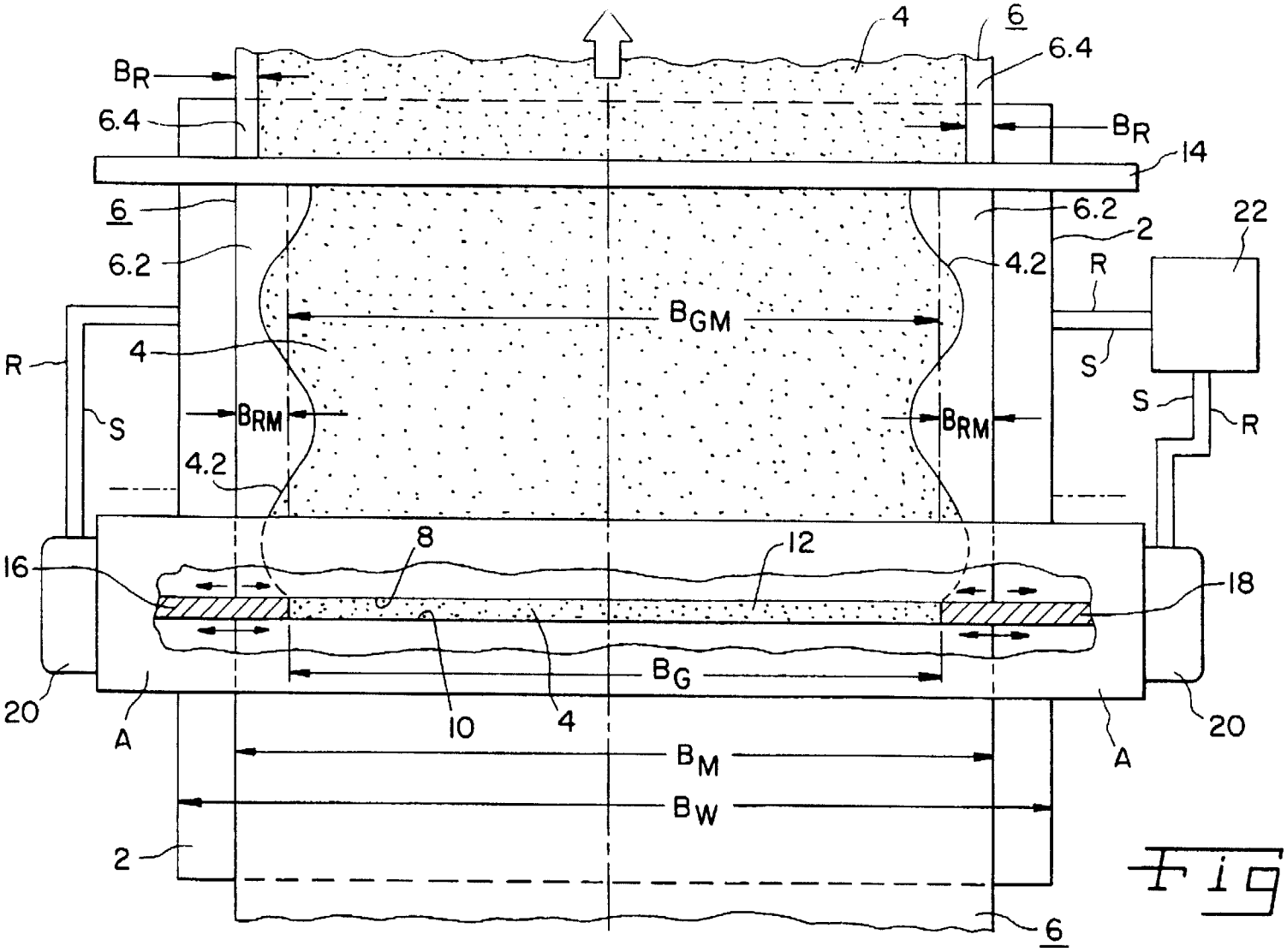
FIG. 1 is a schematic partial view of one embodiment of an applicator of the present invention.

Referring now to the drawings and particularly to FIG. 1, there is shown a schematic partial view of an embodiment of the inventional applicator configured for direct application. The applicator includes a backing roll 2, with a width $B_W$, on which runs a material web 6 to be provided with an application, that is, with a liquid or pasty coating medium 4. Material web 6 is carried by backing roll 2 during the application process. Material web 6 has a width $B_M$. Pasty coating medium 4 and the area to be coated with the pasty coating medium are shown stippled in FIG. 1. The direction of travel of material web 6 is indicated by an arrow. Configured as an open-jet nozzle and extending transversely to the direction of travel of paper web 6, an applicator A opposes backing roll 2. The open-jet nozzle of applicator A is formed by a dosing slot 12 bounded by two lips 8, 10. Applicator A is followed in the travel direction of the material web 6 by a doctor element extending across the entire machine width, presently a doctor blade 14, scraping coating medium 4, which is applied at surplus, down to a suitable profile.

Applicator A includes an adjustable coating edge delimiting apparatus 16, 18 bounding dosing slot 12 on its two side edges, thus presetting a specific coating width of application 4 on backing roll 2 and on material web 6 running on it. The coating edge delimiting apparatus includes two coating edge delimiting elements, hereafter referred to as deckle slides 16, 18, with each of deckle slides 16, 18 being coordinated with a corresponding side edge of traveling material web 6. Deckle slides 16, 18 are positioned movably within a lateral edge area of dosing slot 12. The movable arrangement of each of deckle slides 16, 18 is such that it allows, for adjustment of coating width $B_G$, easy sliding in the longitudinal direction of dosing slot 12, i.e., transverse to the direction of travel of material web 6. The movable arrangement of each of deckle slides 16, 18 also allows an oscillating movement for manipulation of the coating edge. The oscillating movability of deckle slides 16, 18 is indicated in the figure by a double arrow, the plain slidability by two separate, opposed arrows of opposite direction.

Each of deckle slides 16, 18 is, via suitable means of connection, coupled to a drive system, such as an electric actuator 20, and is movable by actuator 20 in the manner described above. Actuators 20 of both deckle slides 16, 18 are incorporated in a closed loop R and a control circuit S of a common control/regulating system 22, allowing an operator to adjust a mean coating width $B_{GM}$ for a given material web width $B_M$ or a given width $B_W$ of backing roll 2, and to preset, as needed, the exact motion of deckle slides 16, 18.

As already indicated above, two deckle slides 16, 18 are, in the operation of applicator A, moved in a direction toward the center of the machine by means of actuators 20. In the present embodiment, however, deckle slides 16, 18 perform a slow harmonic oscillation with an amplitude of about 10 mm in the longitudinal direction of applicator A.

As is evident from FIG. 1, mean coating width $B_{GM}$ is selected such that two uncoated edges 6.2 are left on material web 6. The motion of deckle slides 16, 18 produces a wavy edge pattern 4.2 (which shows graphically the harmonic motion of deckle slides 16, 18) of applied liquid or pasty coating medium 4 without any abrupt transition between a coated area and uncoated areas 6.2. Accordingly, the relevant local width of uncoated edge 6.2, for which a mean edge width $B_{RM}$ similar to mean coating width $B_{GM}$, is to be suitably defined, varies before coated material web 6 passes through doctor blade 14. Wavy edge pattern 4.2 is then, under the effect of doctor blade 14, wiped clean to a uniform uncoated edge 6.4 of essentially constant width $B_R$ as coated material web 6 passes doctor blade 14. The technical problems associated with the prior art, with respect to the pronounced local wear of doctor blade 14, do not occur with the present invention.

Figure 2A:
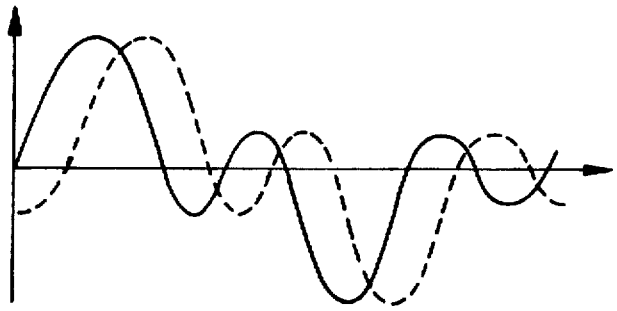
FIGS. 2*a*–2*e* are graphical illustrations of various forms of motion or oscillation of the coating edge delimiting apparatus of the inventional applicator shown in FIG. 1.
Figure 2B:
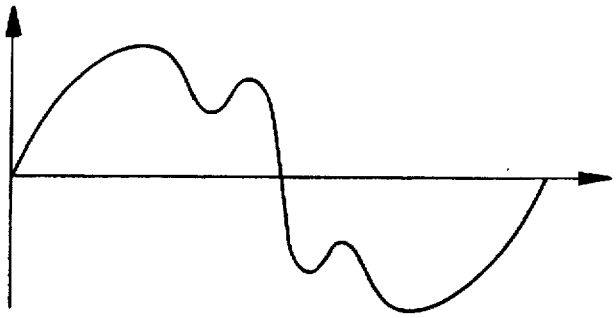
Figure 2C:
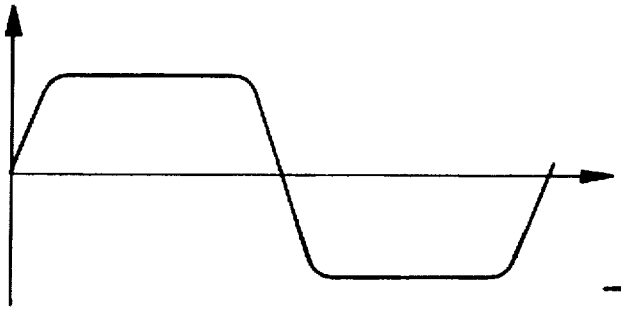
Figure 2D:
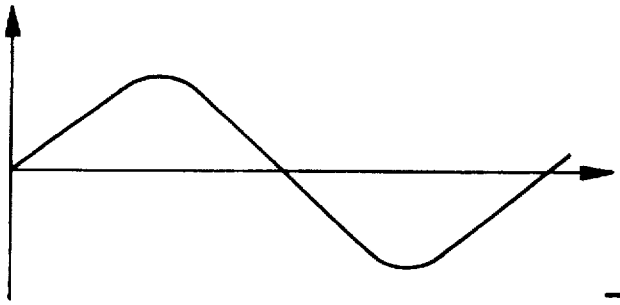
Figure 2E:
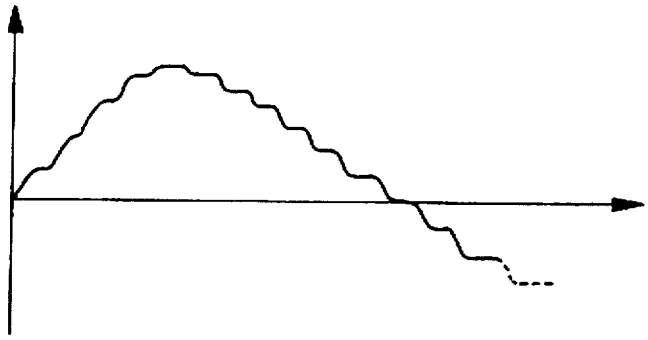
Figure 3:
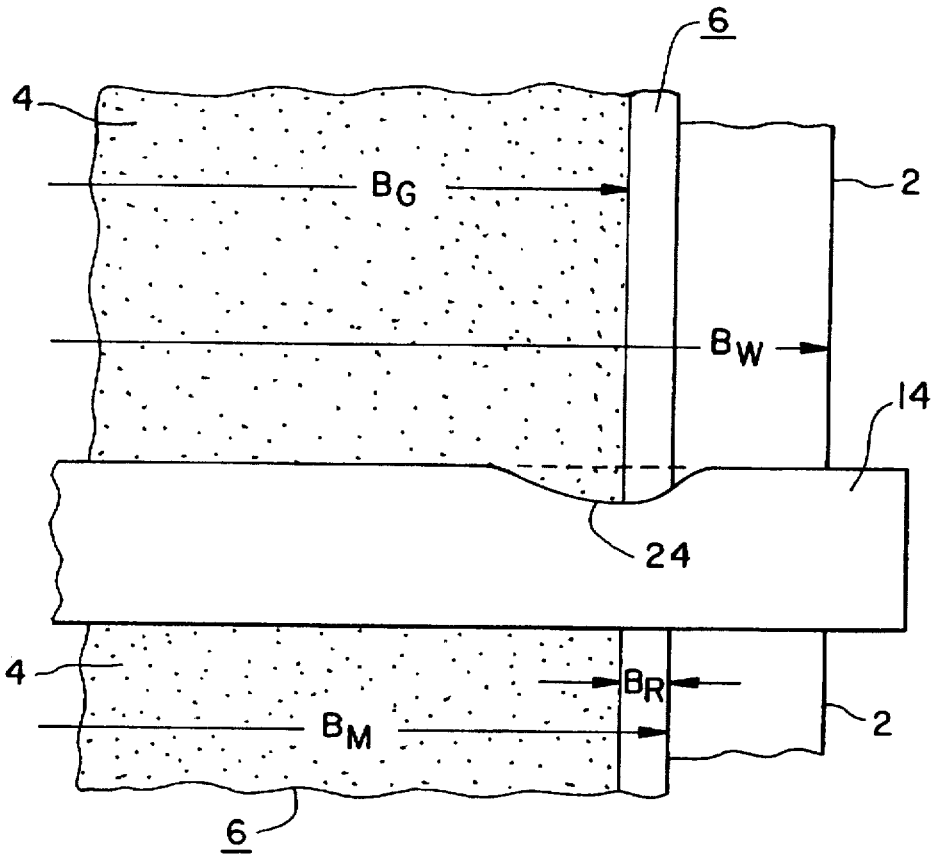
PRIOR ART Fig. 3
FIG. 3 is a schematic plan view of a prior-art applicator in the area of the doctor element and of the edge of the material web.

FIGS. 2*a*–2*e* are graphical illustrations of the coating edge delimiting apparatus, i.e., of relevant deckle slides 16, 18 of the inventional applicator. The abscissa of each diagram represents the time axis, while the ordinate represents the amplitude axis. The illustrated forms of motion or oscillation are exclusively of an exemplary nature. The invention, naturally, is not fixed to these forms of oscillation. The motions of individual deckle slides 16, 18, furthermore, may basically take place in phase or out of phase, indicated in FIG. 2*a* by the dashed curve. Moreover, the forms of oscillation of individual deckle slides 16, 18 may be uniform or different. Visible in FIG. 2*e* is an oscillating basic motion of respective deckle slides 16, 18 with a superimposed stepwise motion. Beyond that, the diagrams are self-explanatory, making further comments superfluous.

The invention is not limited to the above exemplary embodiments, which merely explain the basic idea of the invention. Within the scope of protection, the applicator according to the invention may also assume configurations other than described above. Specifically, the transition between the coated and uncoated edge need not be located on the material web itself, as in the exemplary embodiment, but can also exceed the edge of the material web and be located, in part or exclusively, on the backing roll. The exact form of the oscillating motion of the coating edge delimiting apparatus may assume any suitable form of oscillation. The amplitude and/or wavelength and/or frequency of the oscillation may also vary. A coating edge delimiting apparatus other than the one described above can be used, as can other suitable drive systems for the coating edge delimiting apparatus. Moreover, drive systems that are separate from each other may be used to adjust the coating width by the performance of the continuous, stepwise and/or oscillation motion of the coating edge delimiting apparatus. Lastly, it is, in the sense of the invention, not absolutely necessary for the coating edge delimiting apparatus to be forced by the drive system to perform an oscillating motion; the coating edge delimiting apparatus can also be stimulated to naturally oscillate in a suitable manner.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for one of direct and indirect application of a coating medium onto a traveling fiber material web, the applied coating having two opposite edges defining a coating width there between, said coating width extends in a transverse direction relative to a direction of travel of the fiber material web, said applicator comprising:

at least one adjustable coating edge delimiting apparatus, each said coating edge delimiting apparatus being associated with a corresponding one of the opposite edges of the applied coating, at least one drive system connected to at least one said coating edge delimiting apparatus for driving said at least one coating edge delimiting apparatus in at least one of a stepwise, continuous and oscillating fashion in the transverse direction to provide a varying coating width; and a doctor element disposed after said at least one adjustable coating edge delimiting apparatus relative to the direction of travel of the fiber material web, said doctor element being configured to provide a substantially constant final coating width in conjunction with said varying coating width.

2. The applicator of claim 1, further comprising at least one control system in communication with said at least one drive system.

3. The applicator of claim 1, wherein said applicator comprises a dosing slot, said dosing slot having a width with two opposite ends, said width of said dosing slot extending in the transverse direction, each said coating edge delimiting apparatus being disposed at a respective said end, each said coating edge delimiting apparatus configured for adjusting said width of said dosing slot to provide said varying coating width.

4. A method for one of direct and indirect application of a coating medium onto a traveling fiber material web having a width, said method comprising the steps of:

providing an applicator including at least one adjustable coating edge delimiting apparatus;

adjusting a coating width on at least one of an applicator roll, a backing roll and a traveling material web by moving at least one said coating edge delimiting apparatus in at least one of a stepwise, continuous and oscillating fashion in a direction substantially transverse to the width of the fiber material web;

providing a doctor element, said doctor element being disposed after said applicator relative to a direction of travel of the fiber material web; and using said doctor element to substantially eliminate variations in said coating width.

5. The method of claim 4, wherein said adjusting step moves said at least one coating edge delimiting apparatus in the oscillating fashion with an amplitude of approximately 10 mm.

* * * * *